US006905331B2

(12) United States Patent
Lin

(10) Patent No.: US 6,905,331 B2
(45) Date of Patent: Jun. 14, 2005

(54) GAS BURNER WITH LAMINATE CATALYTIC DEVICE

(76) Inventor: Hwai-Tay Lin, Akara Building, 24 de Castro Street, Wickhams Cay I, Road Town, Tortola (VG)

( * ) Notice: Subject to any disclaimer, the term of this patent is extended or adjusted under 35 U.S.C. 154(b) by 252 days.

(21) Appl. No.: 10/134,773

(22) Filed: Apr. 29, 2002

(65) Prior Publication Data

US 2003/0108840 A1 Jun. 12, 2003

(30) Foreign Application Priority Data

Dec. 6, 2001 (TW) ..... 90221436 U

(51) Int. Cl.[7] ..... F23D 14/14
(52) U.S. Cl. ..... 431/329; 126/406
(58) Field of Search ..... 431/329, 344, 431/345; 126/406

(56) References Cited

U.S. PATENT DOCUMENTS 5,083,916 A * 1/1992 Glennon et al. ..... 431/344
5,135,389 A * 8/1992 Dai et al. ..... 431/328
5,387,399 A * 2/1995 Nishida et al. ..... 422/171
5,476,376 A * 12/1995 Santhouse et al. ..... 431/344
5,485,829 A * 1/1996 Santhouse et al. ..... 126/409
5,810,579 A * 9/1998 Lin ..... 431/328

* cited by examiner

*Primary Examiner*—Alfred Basichas
(74) *Attorney, Agent, or Firm*—Alan D. Kamrath; Nikolai & Mersereau, P.A.

(57) ABSTRACT

A gas burner includes a laminate catalytic device mounted thereon. The gas burner includes a nozzle and an igniter installed in the nozzle. The laminate catalytic device is mounted on the nozzle. The laminate catalytic device includes three separated catalytic nets. The gas burner includes two separators for separating the catalytic nets from one another. The separators are in the form of a ring. Each of the catalytic nets helps burn 80% of gas flowing through it. The gas burner includes a shell for retaining the laminate catalytic device on the nozzle. The shell is in the form of a tube in order to receive the laminate catalytic device and the nozzle. The gas burner includes a bolt inserted in an aperture defined in the shell and an aperture defined in the nozzle, thus securing the shell to the nozzle and retaining the laminate catalytic device in position.

11 Claims, 4 Drawing Sheets

GAS BURNER WITH LAMINATE CATALYTIC DEVICE

BACKGROUND OF INVENTION

1. Field of Invention

The present invention is related to a gas burner and, more particularly, to a gas burner with a laminate catalytic device.

2. Related Prior Art

A conventional gas burner includes a nozzle for spraying gas and an igniter for ignition of the gas sprayed through the nozzle. However, only a small portion of the gas is burnt. To improve ignition of the gas, the conventional gas burner has been improved by addition of a catalytic device onto the nozzle. Thus, about 80% of the gas sprayed through the nozzle and the catalytic device is burnt. However, still 20% of the gas sprayed through the nozzle and the catalytic device is wasted.

The present invention is therefore intended to obviate or at least alleviate the problems encountered in prior art.

SUMMARY OF INVENTION

It is an objective of the present invention to provide an efficient gas burner.

It is another objective of the present invention to provide a gas burner with a laminate catalytic device.

According to the present invention, a gas burner includes a laminate catalytic device mounted thereon. The gas burner includes a nozzle and an igniter installed in the nozzle. The laminate catalytic device is mounted on the nozzle. The laminate catalytic device includes three separated catalytic nets. The gas burner includes two separators for separating the catalytic nets from one another. The separators are in the form of a ring. Each of the catalytic nets helps burn 80% of gas flowing through it. The gas burner includes a shell for retaining the laminate catalytic device on the nozzle. The shell is in the form of a tube in order to receive the laminate catalytic device and the nozzle. The gas burner includes a bolt inserted in an aperture defined in the shell and an aperture defined in the nozzle, thus securing the shell to the nozzle and retaining the laminate catalytic device in position.

Other objectives and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
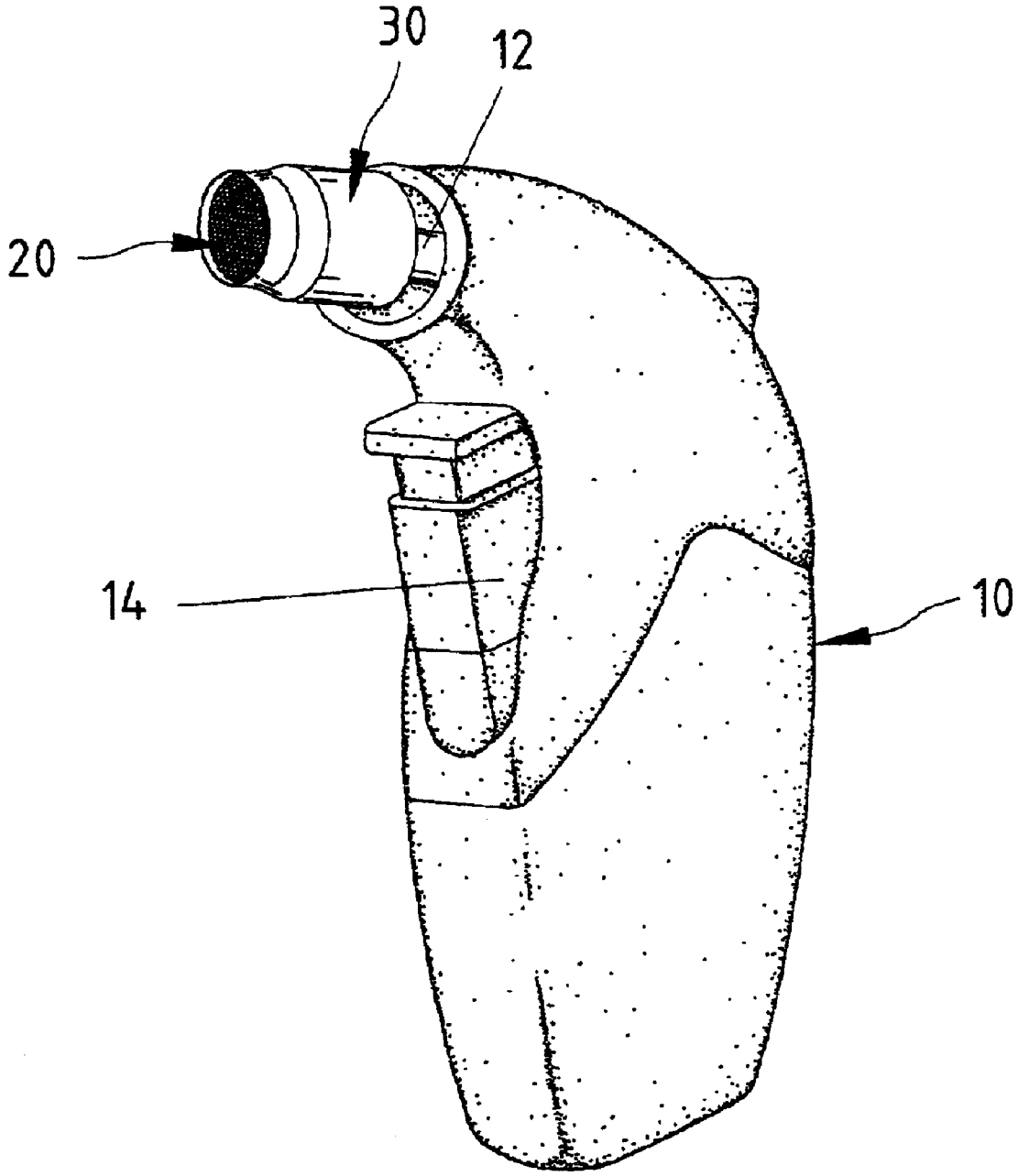
FIG. 1 is a perspective view of a gas burner with a laminate catalytic device according to the present invention.

FIG. 1 shows a conventional gas burner 10 equipped with a novel laminate catalytic device 20 according to the preferred embodiment of the present invention.

Figure 2:
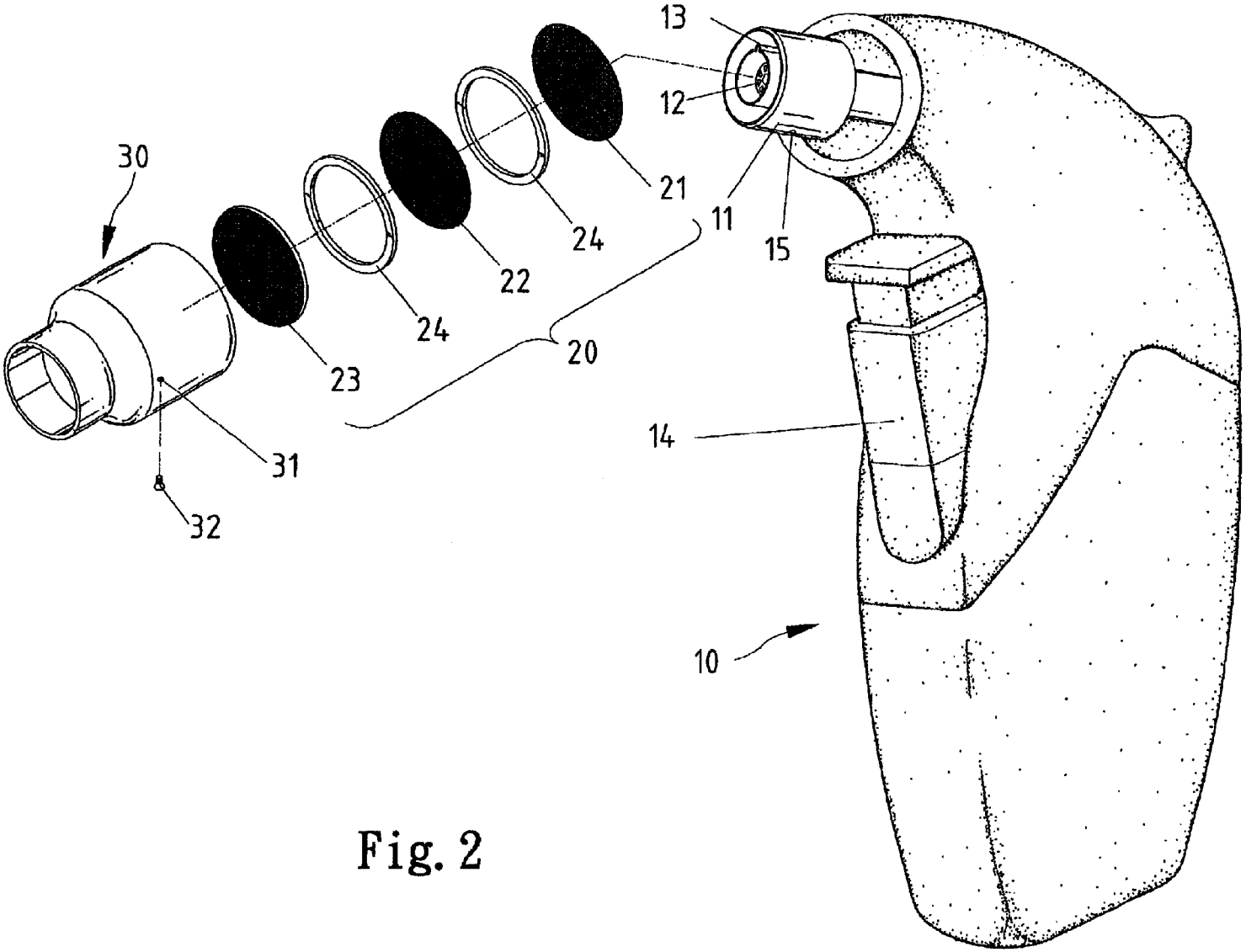
FIG. 2 is an exploded view of the laminate catalytic device shown in FIG. 1.

Referring to FIG. 2, the gas burner 10 includes a nozzle 11 installed at an end of a pipe 12 leading to a gas reservoir (not shown) received therein, an igniter 13 installed in the nozzle 11 and a trigger 14 mounted thereon. When the trigger 14 is operated, gas is transmitted from the gas reservoir through the pipe 12 to the nozzle 11 through which the gas is sprayed and then the igniter 13 is activated. Thus, the gas sprayed through the nozzle 11 is burnt. The gas burner 10 will not be described in detail for being conventional.

Figure 3:
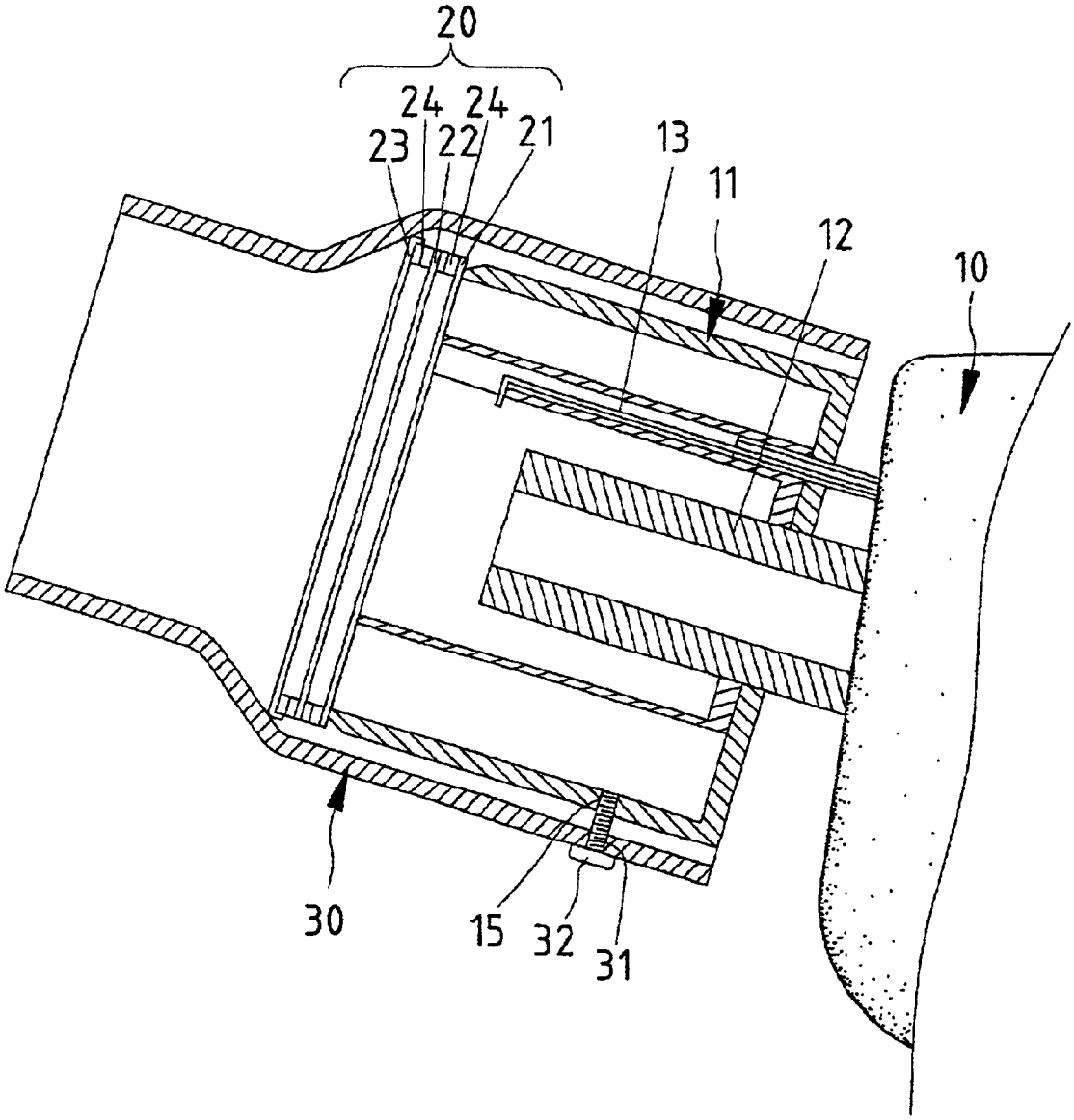
FIG. 3 is a cross-sectional view of a nozzle, an igniter and the laminate catalytic device shown in FIG. 2.

Referring to FIGS. 2 and 3, the laminate catalytic device 20 includes three catalytic nets 21, 22 and 23 separated from one another by means of two separators 24. The separators 24 are in the form of a ring. Each of the catalytic nets 21–23 helps burn 80% of gas flowing through it. The laminate catalytic device 20 is mounted on the nozzle 11.

A shell 30 is used to retain the laminate catalytic device 20 on the nozzle 11. The shell 30 is in the form of a tube in order to receive the laminate catalytic device 20 and the nozzle 11. A bolt 32 can be inserted in an aperture 31 defined in the shell 30 and an aperture 15 defined in the nozzle 11, thus securing the shell 30 to the nozzle 11 and retaining the laminate catalytic device 20 in position.

Figure 4:
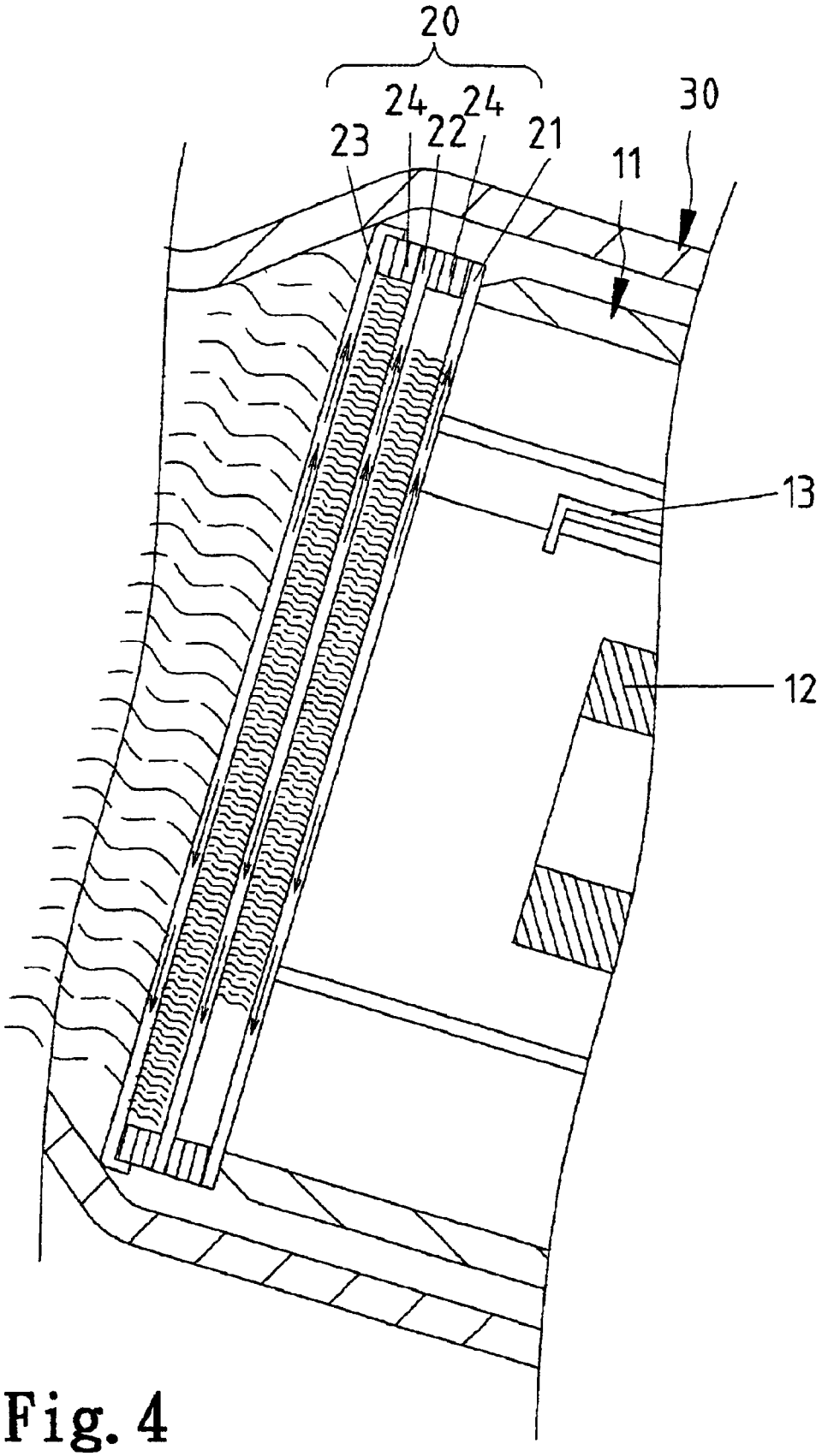
FIG. 4 is an enlarged cross-sectional view of the nozzle, the igniter and the laminate catalytic device shown in FIG. 3.

Referring to FIG. 4, the first catalytic net 21 helps burn 80% of the gas sprayed through the nozzle 11. Thus, 20% of the gas sprayed through the nozzle 11 flows to the second catalytic net 22. The second catalytic net 22 helps burn 80% of the gas flowing through it, i.e., 16% (20%*80%) of the gas sprayed through the nozzle 11. Thus, 4% (100%–80%-16%) of the gas sprayed through the nozzle 11 flows to the third catalytic net 23. The third catalytic net 23 helps burn 80% of the gas flowing through it, i.e., 3.2% (4%*80%) of the gas sprayed through the nozzle 11. Thus, 99.2% (80%+16%+3.2%) of the gas sprayed through the nozzle 11 is burnt due to the laminate catalytic device 20. That is, only 0.8% of the gas sprayed through the nozzle 11 leaves the laminate catalytic device 20 without being burnt.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A gas burner comprising, in combination: a nozzle, an igniter installed in the nozzle; a shell in the form of a tube; and a laminate catalytic device mounted on the nozzle, with the laminate catalytic device including first, second and third catalytic nets and first and second separators in the form of a ring having an inner diameter, with the catalytic nets having a size greater than the inner diameters of the separators, with the first separator sandwiched between and separating the first and second catalytic nets and the second separator sandwiched between and separating the second and third catalytic nets, with the shell receiving the laminate catalytic device and the nozzle, with the third catalytic net being sandwiched between the shell and the second separator and the first catalytic net being sandwiched between the nozzle and the first separator whereby the shell retains the laminate catalytic device on the nozzle.

2. The gas burner according to claim 1 including a bolt inserted in an aperture defined in the shell and an aperture defined in the nozzle, thus securing the shell to the nozzle and retaining the laminate catalytic device in position.

3. The gas burner according to claim 2 wherein each of the catalytic nets helps burn 80% of gas flowing through it.

4. The gas burner according to claim 3 with the second separator having an outer diameter, with the size of the third catalytic net being greater than and extending over the outer diameter of the second separator, with the shell sandwiching the third catalytic net outward of the outer diameter of the second separator.

5. The gas burner according to claim 4 with the first separator having an outer diameter, with the nozzle abutting the first catalytic net intermediate the inner and outer diameters of the first separator.

6. The gas burner according to claim 4 with the first and second separators being of an equal size, with the size of the third catalytic net being larger than the first and second catalytic nets.

7. The gas burner according to claim 1 with the second separator having an outer diameter, with the size of the third catalytic net being greater than and extending over the outer diameter of the second separator, with the shell sandwiching the third catalytic net outward of the outer diameter of the second separator.

8. The gas burner according to claim 7 with the first and second separators being of an equal size, with the size of the third catalytic net being larger than the first and second catalytic nets.

9. The gas burner according to claim 8 with the first separator having an outer diameter, with the nozzle abutting the first catalytic net intermediate the inner and outer diameters of the first separator.

10. The gas burner according to claim 1 with the first separator having an outer diameter, with the nozzle abutting the first catalytic net intermediate the inner and outer diameters of the first separator.

11. The gas burner according to claim 10 with the first and second separators being of an equal size, with the size of the third catalytic net larger than the first and second catalytic nets.

* * * * *